United States Patent [19]

Larker et al.

[11] 4,409,029

[45] Oct. 11, 1983

[54] CONTAINER FOR ENCLOSING RADIOACTIVE WASTE AND A METHOD FOR TREATING WASTE ENCLOSED IN THE CONTAINER

[75] Inventors: Hans Larker; Ragnar Tegman, both of Robertsfors, Sweden

[73] Assignee: ASEA Aktiebolag, Västerås, Sweden

[21] Appl. No.: 209,196

[22] Filed: Nov. 21, 1980

[30] Foreign Application Priority Data

May 19, 1980 [SE] Sweden ..... 8003699

[51] Int. Cl.[3] ..... B22F 31/14; B65D 89/04

[52] U.S. Cl. ..... 419/10; 220/1 S; 220/83; 252/633; 264/0.5

[58] Field of Search ..... 252/626, 633; 250/506, 250/507; 264/21.05; 222/96, 92; 75/226, 214; 425/78; 220/15, 83; 72/59

[56] References Cited

U.S. PATENT DOCUMENTS

| | | | |
|---|---|---|---|
| 3,160,502 | 12/1964 | Quartullo | 75/226 |
| 3,970,517 | 7/1976 | Nederveen | 75/226 |
| 4,172,807 | 10/1979 | Larker | 100/100 |

*Primary Examiner*—L. Dewayne Rutledge
*Assistant Examiner*—J. J. Zimmerman
*Attorney, Agent, or Firm*—Watson, Cole, Grindle & Watson

[57] ABSTRACT

A container for enclosing particulate or piece-formed radioactive material which is to be converted into a solid body by isostatic pressing at a high temperature and a high pressure. The container may have a corrugated sheath and suitably a plane lid and a plane bottom. The corrugation makes possible axial compression of the container prior to the pressing. The container may also have a cylindrical sheath and bellows projecting into the sheath and joining the sheath of the container to a lid and a bottom. The bellows make it possible to insert the lid and the bottom by gas pressure, so that the material present in the container is axially compressed.

9 Claims, 2 Drawing Figures

CONTAINER FOR ENCLOSING RADIOACTIVE WASTE AND A METHOD FOR TREATING WASTE ENCLOSED IN THE CONTAINER

BACKGROUND OF THE INVENTION

During reprocessing of nuclear fuel, separated high-level waste material must be treated and stored so as to prevent spreading into the biosphere. The first stage is to transform the waste into a solid state and to, for example, convert it into a solid, crystalline material having good chemical resistance and good resistance to leaching by water. One way of achieving this is to compress, at a high temperature and a high pressure, a mixture of waste and a resistant material in particulate form into a massive, solid body where the active material becomes permanently bound. A method of achieving such a solid body is disclosed in U.S. Pat. No. 4,172,807. Radioactive metal scrap or radioactive ashes may be treated in a similar manner.

A problem when transforming the waste into a solid state is the contamination of the equipment used in the process. In the method according to the abovementioned patent, containers may be filled with waste material in particulate form and sealed in a relatively simple manner. The equipment used for the filling and the sealing is relatively simple and may therefore be cleaned in a simple manner prior to any necessary repair work. The furnace equipment for the hot pressing, on the other hand, is complicated and much more difficult to clean after a possible contamination.

SUMMARY OF THE INVENTION

The invention relates, on the one hand, to a method of enclosing radioactive particulate or piece-formed material in a redundant gas-tight container and converting the material into a solid body by compression at a necessary high temperature and a necessary high pressure, and on the other hand to a container for enclosing the above-mentioned material. The material to be contained may consist of a mixture of radioactive material and a material resistant to leaching by water. A risk of contamination of a furnace and its gas supply system may arise if pressure gas should leak into the capsule during the pressing and, during the decompression after the pressing, blow out radioactive material from the container. The container is suitably made as a multilayer container to make it redundant, thus in all essentials eliminating the risk of leakage. The container is built up of two or more capsules arranged one inside the other.

When the material to be contained possesses such properties that it cannot be packed into high density when filling the container, problems will often occur during the pressing because of great distortion during the compression. A long capsule may be bent to such an extent that it will get into contact with the walls of the furnace space or with heating elements in the furnace, resulting in the furnace being damaged and in difficulties in removing the pressed container. Distortion problems arise at a fill factor of about 60% and are accentuated with decreasing fill factor. The difficulties in achieving such a high fill factor as 60% are especially great when it is a question of enclosing pieces of cladding tubes.

According to the invention, the distortion problems are reduced and the compression is facilitated by enclosing the material to be compressed in a container of such a shape that an axial compression of the container is facilitated. The container may be made with a corrugated sheath with a substantially plane lid and plane bottom, or with a cylindrical sheath with a lid and/or bottom which is/are joined to the sheath by a bellows projecting into the sheath. This bellows or these bellows make possible an axial insertion of the lid and the bottom and an axial compression of the contained material. The material contained in the container is converted in a known manner into a solid body by compression at a high temperature, for example, by isostatic pressing in a pressure furnace under the influence of a gaseous pressure medium, or by pressing in a closed cavity with talcum or a similar material as a surrounding pressure medium and with a punch projecting into the cavity as a pressure-generating member. The latter method of pressing is disclosed in U.S. patent application Ser. No. 123,731.

The filling density may be increased prior to the hot pressing by an axial compression of the container in cold condition. When enclosing tubular pieces of cladding material, which may have as low a fill factor as 10–15%, this precompaction prior to the hot pressing is particularly desirable. This compression may be carried out between press tables, or between pistons in a hydraulic press, or isostatically in a pressure chamber under the influence of a gaseous or liquid pressure medium. This latter method of pressing is possible for a container with a corrugated sheath because of its great radial stiffness but small axial stiffness. The compression before the hot pressing to a density exceeding 40% of the theoretical density is desirable, and compression to a density exceeding 70% of the theoretical density is often achievable. The axial compression of the material in the capsule results in a smaller radial compression of the sheath during the final hot pressing into a solid body than what would otherwise be the case. This contributes effectively to reduce the distortion during the hot pressing. During the compression before the hot pressing the container is suitably placed in a container with axial guide means preventing bending of the container during its axial compression.

The corrugated sheath and the bellows also facilitate the axial compression during the hot pressing. During the pressing in the pressure furnace a somewhat greater axial compression is obtained than with a container of a conventional design.

The invention will now be described in greater detail with reference to the accompanying drawings.

DETAILED DESCRIPTION OF THE PREFERRED EMBODIMENTS

Figure 1:
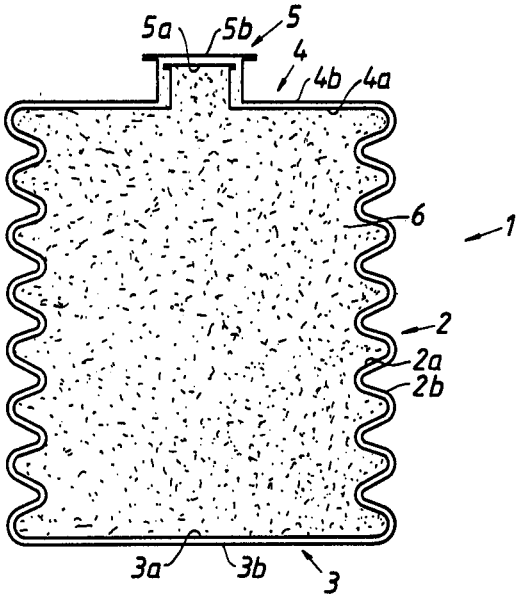
FIG. 1 shows a schematic side view of one embodiment of inventive container, the container having a corrugated sheath.

The container 1 according to FIG. 1 is constructed with a corrugated sheath 2, with a plane bottom 3 and with a plane lid 4. The opening of the lid 4 is gas-tightly sealed by the lid 5. The container 1 is built up of two sheet-metal capsules arranged one inside the other, the sheaths, bottoms and lids of the capsules being designated 2*a*, 2*b*, 3*a*, 3*b*, 4*a*, 4*b* and 5*a*, 5*b*. The container 1 is filled with a radioactive material 6. The material of the inner capsule may be titanium, and that of the outer capsule may be stainless steel.

Figure 2:
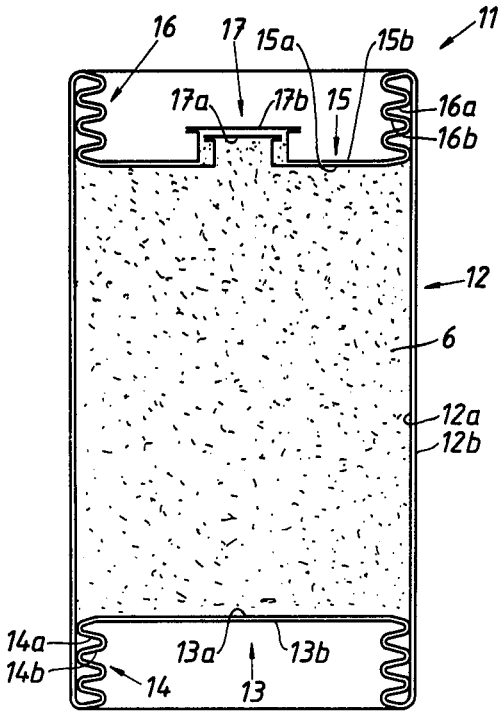
FIG. 2 shows a schematic side view of a second embodiment of inventive container, the container having a smooth sheath and as well as a lid and a bottom which are joined to the sheath by bellows.

The container 11 according to FIG. 2 is constructed with a cylindrical sheath 12, a plane bottom 13, which is joined to the sheath 12 by a bellows 14 projecting into the container 11, and a lid 15, which is joined to the sheath 12 by a bellows 16 projecting into the container 11. The opening of the lid 15 is sealed by a lid 17. The container 11 is built up of two sheet-metal capsules arranged one inside the other, the sheaths, bottoms, bellows and lids of which are designated 12*a*, 12*b*, 13*a*, 13*b*, 14*a*, 14*b*, 16*a*, 16*b*, 15*a* and 15*b*. The container 11 is filled with a radioactive material 6.

We claim:

1. A method for converting radioactive particulate and piece-formed material into a solid body comprising enclosing the material in a gas-tight container having a cylindrical corrugated sheath; and consolidating and bonding the material by pressing the container under temperature and pressure conditions sufficient to cause bonding of the material, said consolidating and bonding step including the step of isostatically pressing the container and the material therein at an elevated temperature whereby to convert the enclosed material into a solid body.

2. A method for converting radioactive particulate and piece-formed material into a solid body comprising enclosing the material in a gas-tight container have a generally cylindrical sheath and a pair of end closures, at least one of said closures being joined to the sheath by bellows means; and consolidating and bonding the material by pressing the container under temperature and pressure conditions sufficient to cause bonding of the material, said consolidating and bonding step including the step of isostatically pressing the container and the material therein at an elevated temperature whereby to convert the enclosed material into a solid body.

3. A method as set forth in claim 1 wherein the container is pressed isostatically at room temperature in a pressure chamber under the influence of a fluid pressure medium before the isostatic consolidation at elevated temperature.

4. A method as set forth in claim 3 wherein the container is pressed to such an extent that the enclosed material is densified to 40% of the theoretically possible density.

5. A method as set forth in claim 2 wherein the container is pressed isostatically at room temperature in a pressure chamber under the influence of a fluid pressure medium before the isostatic consolidation at elevated temperature.

6. A method as set forth in claim 5 wherein the container is pressed to such an extent that the enclosed material is densified to 40% of its theoretically possible density.

7. A container especially adapted for enclosing particulate or piece-formed radioactive material during conversion of the latter into a solid body by isostatic pressing at a high temperature and a high pressure, said container comprising a cylindrical sheath, a pair of spaced end closures and a bellows means connecting at least one of said end closures to the cylindrical sheath.

8. A container as set forth in claim 7 wherein separate bellows means connect each of said end closures to the cylindrical sheath.

9. A container as set forth in claim 7 wherein the container is formed of two metal capsules.

* * * * *